United States Patent [19]

Mattson

[11] 4,027,784

[45] June 7, 1977

[54] TUBE DISPENSER

[76] Inventor: Gary Mattson, Box 280, Nashwauk, Minn. 55769

[22] Filed: Aug. 24, 1976

[21] Appl. No.: 717,026

[52] U.S. Cl. ..... 222/102
[51] Int. Cl.[2] ..... B65D 35/28
[58] Field of Search ..... 222/102, 101, 96, 392

[56] References Cited

UNITED STATES PATENTS

| | | | |
|---|---|---|---|
| 1,710,658 | 4/1929 | George | 222/102 |
| 1,989,713 | 2/1935 | Smith et al. | 222/102 X |
| 2,057,311 | 10/1936 | Puderbaugh | 222/96 |
| 3,252,624 | 5/1966 | Watson, Jr. | 222/102 X |

*Primary Examiner*—Stanley H. Tollberg

[57] ABSTRACT

A device for dispensing the contents of collapsible tubes is provided having a carriage with compressor means adapted to engage both sides of the tube with valve means mounted at the base of the tube and operatively associated with tension means that continuously forces the compressor means downwardly along the tube and which tension means is automatically activated when the valve means is opened to permit a flow of the contents of the tube therethrough.

9 Claims, 9 Drawing Figures

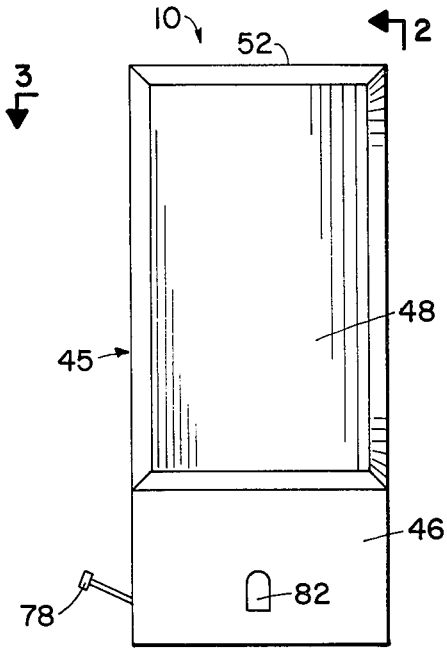
FIG. 1
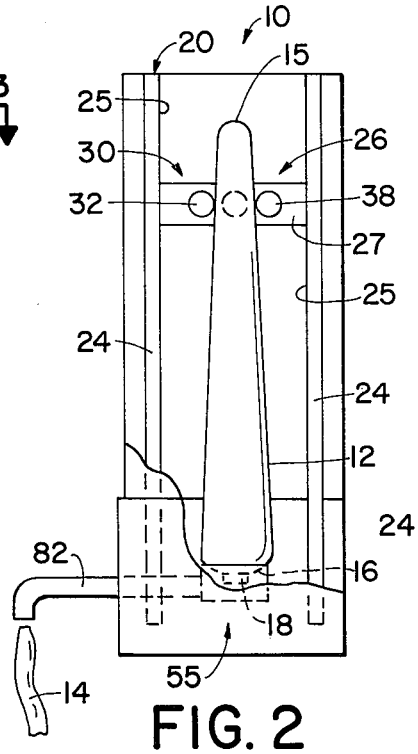
FIG. 2
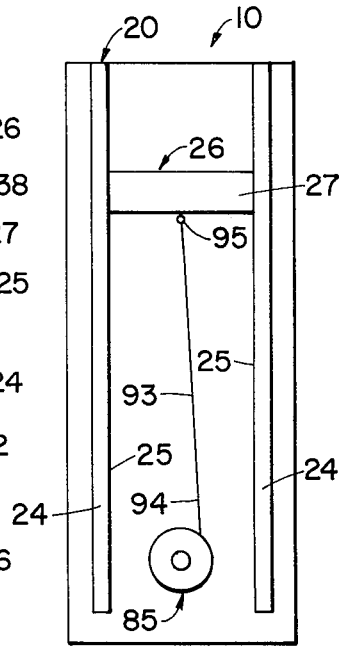
FIG. 4
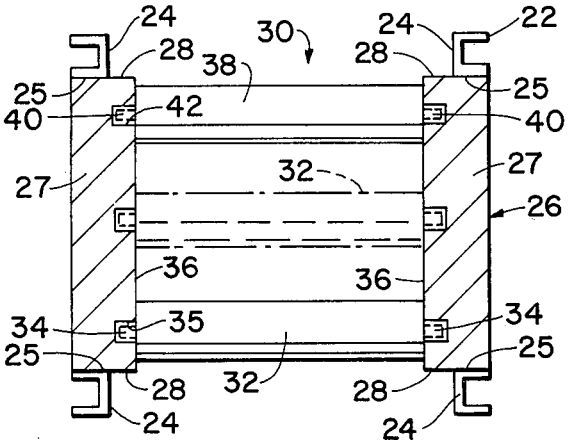
FIG. 3
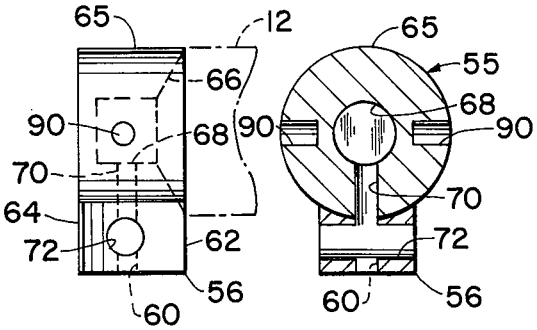
FIG. 6 FIG. 7
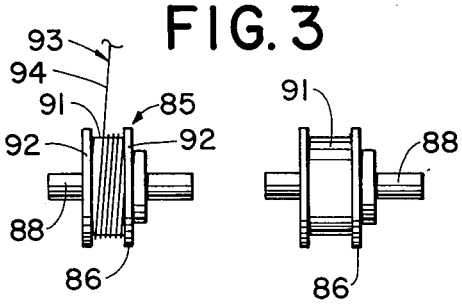
FIG. 5
FIG. 10
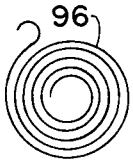
FIG. 8
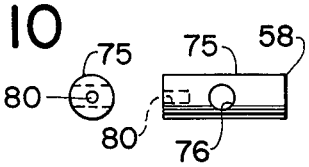
FIG. 9

TUBE DISPENSER

BACKGROUND OF THE INVENTION

This invention relates to improvements in means for holding a collapsible tube and dispensing the contents thereof, and has particular reference to a holding a dispensing device characterized by improved construction and operation, which is expecially suitable for use with collapsible tubes containing toothpaste, shaving cream and the like.

OBJECTS OF THE INVENTION

An object of the present invention is to provide a device for dispensing the contents from collapsible tubes of various lengths and sizes, and which is adapted for effecting content-dispensing collapse of the tube in a positive and highly effective manner.

Another object of the present invention is to provide a device that includes a mechanism that maintains compressor means immediately operative upon opening of the valve means for release of the contents of the tube.

Another object of the present invention is to provide a device that has tension means that automatically moves a carriage carrying a press roll on each side of the tube when the valve is opened.

Another object of the present invention is to provide valve means readily removable from the device for cleaning.

Other objects and advantages of the present invention will become apparent as the disclosure proceeds.

SUMMARY OF THE INVENTION

A device for holding a collapsible tube and dispensing the contents thereof, comprising a frame adapted for vertical mounting and including a vertical trackway having a carriage supported on the trackway for movement along a tube adapted to be positioned within the frame. Compressor means is operatively associated with the carriage and includes a first press roll freely rotably supported on the carriage for engaging one side of the tube and a second press roll freely rotably supported on the carriage for engaging the other side of the tube and mounted in fixed spaced apart relation to the first press roll so as to expel the contents of the tube as the carriage is moved downwardly relative to the tube.

Valve means is removably carried by the frame at the lower end of the trackway and includes a valve member having a valve discharge port with a seat communicating with the valve discharge port and adapted for receiving the discharged end of the tube to locate the same in alignment with the trackway, as well as a valve stem adapted to be moved between an open position in communicating relation with the discharge port to a closed position in non-communicating relation with the discharge port. Tension means is provided for applying a downwardly directed force to the carriage which is operable to effect step-by-step movement thereof in tube-collapsing advance along the tube for expelling the contents thereof. The tension means being activated when the valve stem is moved into the open position to permit the contents of the tube to flow outwardly therefrom and deactivated when the valve stem is in its closed position.

BRIEF DESCRIPTION OF THE DRAWINGS

Although the characteristic features of this invention will be particularly pointed out in the claims, the invention itself, and the manner in which it may be made and used, may be made and used, may be better understood by referring to the following description taken in connection with the accompanying drawings forming a part hereof, wherin like reference numerals refer to like parts throughout the several views and in which:

FIG. 1 is a front view of the device in accordance with the present invention;

FIG. 2 is a side view, partly in section, taken along lines 2—2 of FIG. 1;

FIG. 3 is an enlarged sectional view taken along line 3—3 of FIG. 1;

FIG. 4 is a side view of the device illustrating the tension means associated therewith;

FIG. 5 is an end view of the spools utilized as part of the tension means;

FIG. 6 is a side view of the valve member mounted within the device;

FIG. 7 is a top view in section of the valve member illustrated in FIG. 6;

FIG. 8 is a side view of the coiled spring contained within the spools illustrated in FIG. 5;

FIG. 9 is a side view of the value stem for use in conjunction with the valve member illustrated in FIGS. 6 and 7; and FIG. 10 is an end view if the valve stem illustrated in FIG. 9.

DETAILED DESCRIPTION OF THE DRAWINGS

Referring now to the drawings, there is illustrated in FIGS. 1–10 a device 10 manufactutred of suitable rigid material, either metal, plastic, or a combination thereof, and adapted to be mounted with suitable wall bracket elements or the like (not shown) by which the device is mounted preferably in a vertical position on a wall or other support (not shown). The device 10 acts for holding of a collapsible tube 12 and dispensing the contents 14 therefrom. The tube 12 may be of various sizes or lengths and the contents may vary depending upon the user. The tube 12 has a rear end 15, a front end 16, with an open neck portion 18.

The device 10 includes a frame 20 including a vertical trackway 22 that may include a pair of vertically extending tracks or rails 24 with one pair of the tracks 24 extending on each side of the frame 20. The tracks 24 have inwardly disposed vertically extending surfaces 25 extending in parallel spaced apart relation to each other and adapted to receive therebetween a carriage 26.

The carriage 26 is supported on the trackway 22 for movement along the tube 12 adapted to be positioned within the frame 20. The carriage 26 includes a pair of mounting blocks 27 each having a contacting surface 28 for engagement with the extending surfaces 25 of the rails 24. As seen in FIG. 3, this relationship permits vertical displacement of the mounting blocks 27 between the rails 24.

Compressor means 30 is operatively associated with the carriage 26 and includes a first press roll 32 freely rotably supported on a shaft 34 adapted to extend within a recess 35 on the inner surface 36 of each mounting block 27. One end of the shaft 34 is spring loaded so as to permit it to snap in and out of engagement with its mating recess 35. A spring (not shown)

extends axially within the roll 32 in order to permit the necessary displacement of one end of the shaft 34. A second press roll 38 is similarly provided with a respective shaft 40 extending from each end thereof and positioned within a recess 42. If desired, roll 38 may also be of the design in which one end of the shaft is spring loaded so as to be placed in and out of the recess 42.

The purpose for providing the rolls 32 and 38, which have a circular configuration as seen in FIG. 2, removable is to permit a change of position depending upon the size of the tube 12 in the device 10. As illustrated in FIG. 3, roll 32 is illustrated in phantom in the alternate position as therein illustrated. Removal of each roll is also desirable for cleaning, maintainance, etc. Roll 32 and 38 engage opposite sides of the tube 12 and are mounted in fixed spaced apart relation to each other such that they act to expel the contents 14 of the tube 12 as the carriage 26 is moved downwardly relative to the front end 16 of the tube.

The frame 20 is contained within housing means 45 which may take various forms, shapes, etc., and having a front wall 46 that may include a transparent panel 48 to permit the user to see at what level the carriage 26 is at in order to be aware of when the tube 12 will require replacement. In addition, the rectangular housing means 45 may have side walls 50 and a cover 52 adapted to be removed therefrom for gaining access to the frame 20 for insertion and removal of the tube 12 therefrom.

Valve means 55 is removably carried by the frame 20 at the lower end of the trackway 22 and includes a valve member 56 illustrated in FIGS. 6 and 7 that operates in conjunction with a valve stem illustrated in FIGS. 9 and 10 and identified by the numeral 58. The valve member 56 includes a valve discharge port 60 extending in a substantially horizontal plane between the upper end 62 and lower end 64 of the valve member 56. The valve member 56 includes a valve head portion 65 which may have a circular configuration as illustrated in FIG. 7. Valve member 56 includes a seat or stop 66 having a frustoconical configuration in conforming relationship with the front end 16 of the tube 12. The seat 66 is provided on the upper end 62 of the head portion 65 with a vertically extending bore 68 communicating therewith and adapted to receive the contents 14 of the tube therein. a transversely extending passageway 70 extends between the bore 68 and the stem cavity 72. The passageway 70 is in axial alignment with the valve discharge port 60 to permit a flow of material into the axial bore 68, passageway 70, and out through the discharge port 60.

The valve stem 58 has an outside diameter 75 that is adapted to be slidably received within the stem cavity 72 for movement therein. The valve stem 58 includes a stem opening 76 of a diameter substantially equal to the passageway 70 and the discharge port 60. A lever 78 is adapted to have one end thereof extend within the stem cavity 80 for receiving one end of the lever 78 in fixed relation thereto. The valve member 56 is mounted within the housing means 45 in a manner such that a discharge faucet or conduit 82 is in alignment with, or extending within, the discharge port 60.

The lever 78 operates to move the valve stem 58 between an open position in which the stem opening is in alignment with the passageway 70 to a closed position in which the stem opening 76 is in non-communicating relation with the discharge port 60, thereby preventing an outward flow of the contents 14 from the tube 12. Accordingly, the valve means 55 acts to open the system to permit the outward flow of the contents 14 from the tube 12.

In operative relationship with the valve means 55 and the carriage 26, there is provided tension means 85 illustrated in FIGS. 5 and 8 for applying a downwardly directed force to the carriage 26 which is operable to effect step-by-step movement thereof in tube-collapsing advance along the tube 12 for expelling the contents thereof. The tension means 85 is automatically activated when the valve stem 58 is moved into the open position to permit the contents 14 of the tube 12 to flow outwardly therefrom and deactivated when the valve stem 58 is in its closed position.

The tension means 85 includes a pair of spools 86 rotatably mounted relative to the valve member 56. The spool includes an inner shaft 88 adapted to extend within spool apertures 90 contained on the valve member 56 as illustrated in FIGS. 6 and 7. Each spool 86 further includes a drum 91 with side plates 92. In order to connect the carriage 26 to the tension means 85, connecting or coupling means 93 is provided and may be in the form of a cord, string, or cable 94 with one end joined by a hook 95 to the underside of one of the mounting blocks 27. The opposite side of the cord 94 is wound around the drum 91. A coiled spring 96 is mounted within the drum 91 in a manner well known in the art such that the coiled spring 96 provides a continuous downward force by maintaining the proper torque on the drum 91 in relation to the shaft 88. In this manner the first roll 32 and the second roll 38 are always pulled downwardly due to the mounting of the shafts 88 within the apertures 90 and the tension provided by the coiled spring 96 within the drum 91 of the spool 86. Only one coiled spring is utilized in each spool 86. The cord 94 may extend between one or both of the drums 86 to the carriage 26.

This novel relationship produces a device in which stored energy in the spring 96 is transformed into mechanical motion in order to move the carriage 26 downwardly along the tube 12 with sufficient force to compress the walls of the tube 12 and expel the contents 14 thereof. Further, the lever 78 acts like a switch in that by opening the flow path, the resistance is sufficiently reduced to permit the winding up of the spool 86 to pull down the cord 94 and expel the contents of the tube. When the user desires to discontinue operation, the lever 78 is moved to the closed position as described above.

Accordingly, a device with a minimal amount of moving parts has been disclosed for collapsing a tube to expel the contents therefrom.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A device for holding a collapsible tube and dispensing the contents thereof, comprising:

a. a frame adapted for vertical mounting and including a vertical trackway, b. a carriage supported on said trackway for movement along a tube adapted to be positioned within said frame, c. compressor means operatively associated with said carriage including:
1. a first press roll freely rotably supported on said carriage for engaging one side of the tube, and
2. a second press roll freely roatably supported on said carriage for engaging the other side of the tube and mounted in fixed spaced apart relation to said first press roll so as to expel the contents of the tube as said carriage is moved downwardly relative to the tube, d. valve means removably carried by said frame at the lower end of said trackway, said valve means including:
1. a valve member having a valve discharge port with a seat communicating with said valve discharge port and adapted for receiving the discharge end of the tube to locate the same in alignment with said trackway, and
2. a valve stem adapted to be moved between an open position in communicating relation with said discharge port to a closed position in non-communicating relation with said discharge port, e. tension means for applying a downwardly directed force to said carriage which is operable to effect step-by-step movement thereof in tube-collapsing advance along the tube for expeling the contents thereof, said tension means being activated when said valve stem is moved into said open position to permit the contents of the tube to flow outwardly therefrom and deactivated when said valve stem is in its closed position, and f. said tension means includes:
1. at least one spool rotatably mounted relative to said valve member,
2. a coiled tension spring mounted relative to said spool to apply a continuous torque thereto, and
3. means connecting said spool to said carriage to provide continuously thereto a downwardly directed force of said first and second press roll, such that the downward movement of said carriage automatically occurs when said valve stem is in said open position.

2. A device as in claim 1, and further including a lever coupled to said valve stem and extending beyond said frame for manual control thereof.

3. A device as in claim 1,
a. wherein said trackway includes a pair of vertically extending tracks on each side of said frame, and
b. wherein said carriage includes a pair of mounting blocks adapted for vertical movement between each respective pair of said rails.

4. A device as in claim 3, wherein said first and second press roll are removably mounted to said blocks such that the space therebetween is adjustable depending upon the size of the tube therein.

5. A device as in claim 1, wherein said valve member includes:
a. a vertically extending bore communicating with said valve seat and said discharge port, and
b. a pair of spaced apart apertures extending in a horizontal plane and adapted to receive one end of each spool rotatably mounted relative thereto.

6. A device as in claim 5, wherein said means connecting said spool to said carriage includes a cord connected at one end to said carriage and the opposite end thereof wound around said spool.

7. A device as in claim 1, further including housing means enclosing said frame and having a cover adapted to be removed therefrom for gaining access to said frame for insertion and removal of the tube therein.

8. A device as in claim 7, wherein said housing means includes a transparent panel for the user to view the position of said carriage relative to the tube.

9. A device as in claim 7,
a. wherein said trackway includes a pair of vertically extending tracks on each side of said frame, and
b. wherein said carriage includes a pair of mounting blocks adapted for vertical movement between each respective pair of said rails.

* * * * *